US006314973B1

(12) United States Patent
Vellines

(10) Patent No.: US 6,314,973 B1
(45) Date of Patent: Nov. 13, 2001

(54) FLUSHING ACCESSORY FOR OUTBOARD ENGINES

(76) Inventor: John Vellines, 1024 Jamestown Crescent, Norfolk, VA (US) 23508

( * ) Notice: Subject to any disclaimer, the term of this patent is extended or adjusted under 35 U.S.C. 154(b) by 0 days.

(21) Appl. No.: 09/296,524

(22) Filed: Apr. 22, 1999

(51) Int. Cl.[7] ..... B08B 9/00
(52) U.S. Cl. ..... 134/167 R; 440/113
(58) Field of Search ..... 134/166 R, 167 R, 134/168 R, 169 R; 440/88, 113; 138/DIG. 9

(56) References Cited

U.S. PATENT DOCUMENTS

| | | | |
|---|---|---|---|
| 3,931,828 | 1/1976 | Lawler . | |
| 4,246,863 | 1/1981 | Reese . | |
| 4,359,063 | * 11/1982 | Carlson | 134/167 R |
| 4,973,276 | 11/1990 | Mavrelis . | |
| 5,051,104 | 9/1991 | Guhlin . | |
| 5,423,703 | 6/1995 | Lorenzen . | |
| 5,823,836 | 10/1998 | Anderson . | |

* cited by examiner

*Primary Examiner*—Philip R. Coe
(74) *Attorney, Agent, or Firm*—John Wilson Vellines

(57) ABSTRACT

A flushing accessory for connecting a supply of domestic fresh water to the cooling jacket of a marine outboard engine for the purpose of flushing saline residue therefrom. The accessory includes a conventional "earmuffs" assembly which self-adheres to the lower unit of the outboard engine once installed thereon and a long handle enabling the accessory to be installed from within the boat. The handle is hollow, and conducts water from the domestic supply to the "earmuffs" assembly. A connector rigidly and permanently attaches the "earmuffs" assembly to the handle in an orientation such that the axis of the handle is offset from the "earmuffs" assembly. The connector is configured such that a short connector hose conducting water from the handle to the "earmuffs" assembly is disposed in close proximity to the accessory, and is not obliged to form a severe bend. The connector and handle are formed from corrosion resistant materials such as synthetic resins and fiberglass. The handle incorporates a manual valve for controlling water flow to the "earmuffs" assembly.

7 Claims, 3 Drawing Sheets

FLUSHING ACCESSORY FOR OUTBOARD ENGINES

BACKGROUND OF THE INVENTION

1. Field of the Invention

The present invention relates to a device for connecting pressurized water to a marine outboard engine for the purpose of flushing residual saline water from the cooling jacket of the engine. The device has a hollow handle for conducting flushing water from a supply of domestic water and flexible cups or adapters disposed to seal a connection from the pressurized supply to pre-existing water entry ports formed in the outboard engine. The device is self-adhering to the engine after being manually installed over the engine.

2. Description of the Prior Art

Marine outboard engines are usually self-cooling, having water entry ports which allow the same water being negotiated to enter the engine for cooling purposes. A labyrinthine partially enclosed chamber, or cooling jacket, conducts inducted water to circulate throughout the engine and to be discharged after absorbing heat. A water pump integral with the engine imparts propulsive force to the water to assure effective circulation throughout the cooling jacket.

In saline environments, such as the open ocean, corrosive effects of seawater will degrade the metal walls of the cooling jacket. If not checked, corrosion can eventually lead to penetration into combustion chambers and other parts of the engine which cannot be allowed to contact seawater. As a preventive measure, outboard engines are intended to be flushed with fresh or salt free water after each use in the ocean. To accomplish flushing, it is possible to attach a hose connected to a domestic water supply to the inlet ports of the engine. Water circulates in a manner similar to that of cooling water.

To expedite the flushing process, the prior art has developed apparatus enabling convenient attachment to pressurized water. U.S. Pat. No. 3,931,828, issued to Roger J. Lawler on Jan. 13, 1976, and U.S. Pat. No. 5,051,104, issued to Kjall G. Guhlin on Sep. 24, 1991, illustrate two forms of an accessory which enables a hose to be attached and held against an outboard engine. The accessory includes two rubber cups which cover and seal opposed ports formed in the lower unit of a typical outboard engine. The cups are supported on a U-shaped steel spring. The resultant assembly resembles earmuffs, and will be so termed hereinafter for brevity. A hose is connected to one of the cups, which has a throughbore communicating with one of the inlet ports. The other cup is solid, and closes its respective water inlet port. Water entering the first inlet port is eventually discharged at the propeller of the engine.

The above accessories enable a person to connect a hose to the engine for flushing, but the person must be in close proximity to the engine. It would be preferable to perform this task from a more distant location, such as within the boat itself. This requires that a pole be provided and fixed to the earmuffs assembly. U.S. Pat. No. 4,246,863, issued to John T. Reese on Jan. 27, 1981, and U.S. Pat. No. 4,973,276, issued to Peter A. Mavrelis on Nov. 27, 1990, show earmuff assemblies mounted on poles for remote handling. However, neither device is suitable for drawing the earmuff assembly into an operable position from within a boat.

The ability to maneuver an earmuffs assembly into an operable position is shown in U.S. Pat. No. 5,423,703, issued to Thomas H. Lorenzen on Jun. 13, 1995. Lorenzen provides, in addition to a hollow, elongate pole suitable both as a handle and also for conducting water proximate the earmuffs, a metal clamping member which fixes the pole to the earmuffs. However, unlike the present invention, the metal clamping member entails certain disadvantages. One is that being metal, it is susceptible to corrosion by salt water. Another is that it must be adjusted and clamped to the desired position. A further disadvantage is that fasteners maintaining the clamp in the desired position may eventually work loose so that the clamp slips. A still further disadvantage is that the layout of Lorenzen's device is such that a hose necessary to connect water from the handle or pole to the earmuffs cannot be routed in close proximity to the earmuffs. The hose therefore is susceptible to snagging on external objects as it is wielded.

By contrast, the present invention overcomes the above disadvantages and others by virtue of several novel characteristics. One is that the present invention eliminates a separate metal clamping member in favor of monolithic construction requiring neither fasteners nor adjustment. A second characteristic is that the earmuffs are provided with an elbow enabling routing of the water supply hose in close proximity to both the handle or pole and also to the earmuffs. Furthermore, that portion of the device connecting the pole to the earmuffs in the present invention is so configured to enable compact routing of the supply hose to the earmuffs. In a further improvement over Lorenzen, the pole itself is formed as a honeycomb structure from fiberglass. The pole of Lorenzen is solid walled, tubular metal which is more prone to bending than is the rigid yet light weight pole of the present invention.

U.S. Pat. No. 5,823,836, issued to Kenneth J. Anderson on Oct. 20, 1998, illustrates a unitary fitting enabling connection of a water supply hose to an earmuffs assembly. However, the fitting of Anderson does not include a pole suitable for remote installation of the earmuffs onto the outboard engine.

None of the above inventions and patents, taken either singly or in combination, is seen to describe the instant invention as claimed.

SUMMARY OF THE INVENTION

The present invention provides a flushing accessory which enables a person to connect a supply of pressurized water to the lower unit of an outboard engine from within a boat having that engine. The accessory is so constructed that it is more compact, rigid, free from damage by salt corrosion, and free from requiring adjustments and tightening of components than are any of the corresponding prior art flushing accessories enabling remote operation.

The flushing accessory has solid, monolithic construction which is free from fasteners and adjustments found in corresponding prior art devices. Constituent materials include fiberglass and synthetic resins, so that the accessory is not susceptible to deterioration due to salt water.

The accessory includes a handle which also serves as a liquid conduit conducting water to the earmuff assembly, so that a hose can be connected to the free end of the handle. No separate liquid conduit need be provided. A short section of hose conducts water from the handle to one flexible rubber or plastic sealing cup. The handle has honeycomb construction from fiberglass so that it is light yet very rigid. A molded plastic head or connector connects the earmuff assembly to the handle. The head is configured such that the axis of the tubular handle is offset from the earmuff assembly. This construction enables the short section of hose to be unobtrusive and relatively protected in its location on the accessory.

The accessory can be fabricated by molding either by forming and subsequently joining subcomponents other than the earmuff assembly, or by forming the accessory in a single operation around a pre-existing earmuff assembly.

The handle incorporates a valve at its distal end for controlling water flow through the accessory. This feature gives the user control over flushing from his or her position within the boat so that water can be supplied and discontinued with minimal waste. That is, water flow can be established only when the flushing attachment is installed on the outboard engine lower unit.

Accordingly, it is one object of the invention to provide an accessory which enables a boat operator to maneuver an earmuff assembly over the lower unit of a marine outboard engine.

It is another object of the invention to avoid construction which requires adjustments and tightening of components.

It is a further object of the invention that the novel accessory resist corrosion by salt water.

Still another object of the invention is to assure that a liquid conduit be compact and protected by its configuration.

An additional object of the invention is that the accessory be light and easy to maneuver.

It is again an object of the invention that the novel accessory be readily fabricated from molded components.

Yet another object of the invention is to incorporate a valve for controlling water flow through the accessory.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
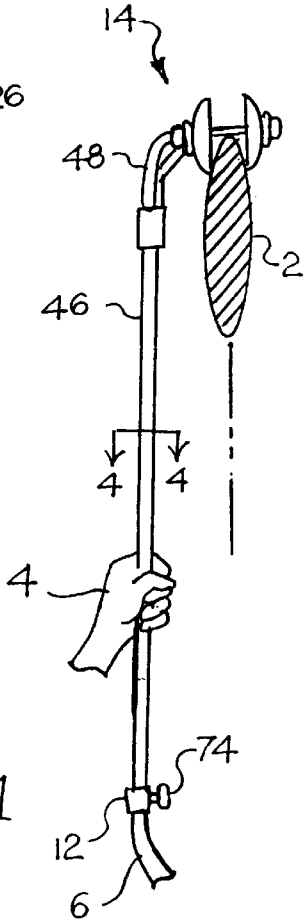
FIG. 1 is an environmental right side elevational view of the invention, with a lower unit of an outboard engine shown diagrammatically in cross section.

FIG. 1 of the drawings shows novel flushing accessory 10 as it is utilized. Accessory 10 is a flushing device which readily and remotely installable over the lower unit 2 of a marine outboard engine (not shown in its entirety), for the purpose of supplying fresh water into the cooling jacket of the engine. A user grasps accessory 10 by his or her hand (shown representatively as 4), and draws accessory 10 over lower unit 2. This can be accomplished when the user is standing inside the boat (not shown), which is a significant advantage of the invention. A supply of domestic fresh water is conducted by a conventional garden hose 6 or other hose having a threaded terminal. Hose 6 is threaded to a compatibly threaded terminal 12 of accessory 10.

Accessory 10 includes a generally conventional "earmuffs" assembly, so called due to a superficial resemblance to its namesake. This assembly will be termed flushing attachment 14 hereinafter. Attachment 14 may comprise the subject device of U.S. Pat. No. 3,931,828, issued to Roger J. Lawler on Jan. 13, 1976, or any equivalent device. Attachment 14 holds accessory 10 to the outboard engine without requiring any effort by the user in a manner so that water flowing from hose 6 enters the outboard engine by cooling ports (not shown) provided to induct water from the ocean for cooling during boat operation. Attachment 10 also seals fluid connection between attachment 10 and the outboard engine.

Figure 2:
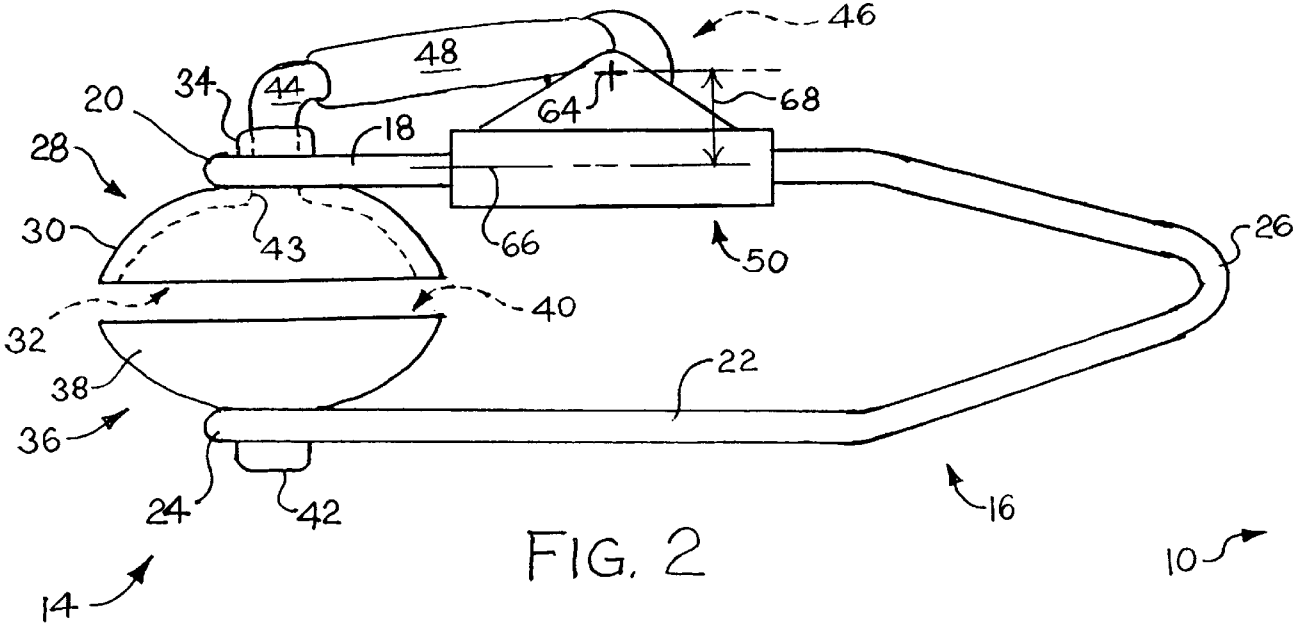
FIG. 2 is a front elevational view of the invention.

Characteristics of attachment 14 will be reviewed, referring now to FIG. 2. Attachment 14 has a U-shaped spring 16 having a first generally straight member 18 terminating in a proximal end 20 and a second straight member 22 terminating in a distal end 24. A bent portion 26 connects first straight member 18 to second straight member 22. A first flexible sealing cup 28 has a bowl portion 30 which defines an open interior portion 32, and a stub 34 projecting from bowl portion 30. Cup 28 is fixed to spring 16. Proximal end 20 of spring 16 constricts about or otherwise securely engages stub 34 of cup 28. A second flexible sealing cup 36 is similarly fixed to spring 16 at distal end 24 of spring 16. Cup 36 has a stub 42 and a bowl portion 38 defining an open interior 40.

Stub 34 is hollow so that it can conduct water, having a throughbore 43 communicating between a hollow elbow fitting 44 and interior 32 of cup 28. Water is conducted from hose 6 (see FIG. 1) through handle 46 (more clearly seen in FIG. 1) to a flexible connector hose 48, then into fitting 44, and finally through cup 28. Cup 28 deforms as it constricts over outboard engine lower unit 2, with throughbore 43 aligning with the inlet port of the outboard engine. Bowl portion 30 flattens against the lower unit, and seals connection between throughbore 43 and the inlet port of the outboard engine.

A flushing circuit is thus established which extends from supply hose 6 through handle 46, then into and through cup 28, into one inlet port of the outboard engine, and through the cooling jacket of the outboard engine (cooling jacket not shown). Flushing water is subsequently discharged at the propeller opening of the outboard engine.

By contrast with cup 28, stub 42 of cup 36 is solid, lacking a throughbore, and therefore closes a second inlet port formed on a side of the lower unit of the outboard engine opposite that communicating with cup 28. This is acceptable since the volume of water required for flushing is less than that required for cooling. It would be possible to supply flushing water into the second inlet port by modifying accessory 10 such that both sealing cups 28, 36 are supplied with water to the outboard engine, but it is preferred for economy of manufacture that only cup 28 be so configured.

Figure 3:
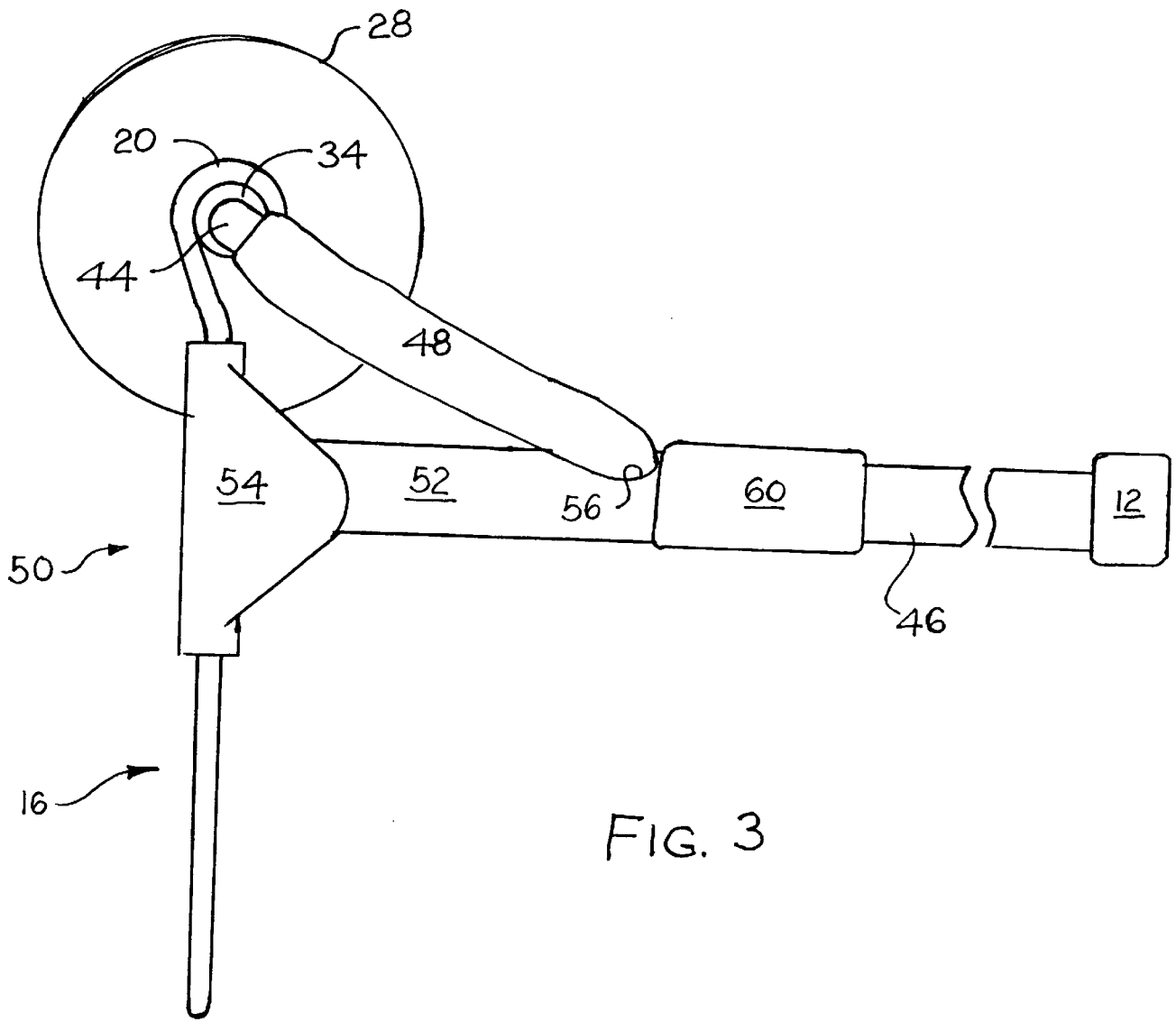
FIG. 3 is a top plan view of the invention.

It will be seen by examining FIG. 1 that handle 46 spans and connects supply hose 6 and attachment 14. Cooperation of and attachment between handle 46 and attachment 14 are explained with reference first to FIG. 3. Attachment 14 is seen to include a head or connector 50. Connector 50 is generally T-shaped, and serves the function of holding spring 16 in a fixed, permanent position generally but not precisely perpendicular to handle 46. Connector 50 is fabricated from a synthetic resin, fiberglass, or any other corrosion resistant material, and preferably from a material which enables connector 50 to be molded. Connector 50 mounts rigidly to flushing attachment 14 and handle 46 in the embodiment depicted herein, but alternatively could be formed integrally with handle 46 or with attachment 14, if desired.

Connector 50 engages spring 16 in any suitable way. For example, spring 16 may be engaged by a strong adhesive. Alternatively, spring 16 may be embedded within connector 50 when molding the latter. The method of fabrication is not important, as long as it assures that attachment 14 be permanently fixed to handle 46 in a proscribed orientation which will be described hereinafter.

Connector 50 comprises a stem 52 and a cross piece 54. Cross piece 54 engages spring 16 of attachment 14. Stem 52 engages one end of handle 46. In the preferred embodiment illustrated herein, stem 52 is hollow. Connector hose 48 enters stem 52 through an upwardly directed opening 56, and terminates in fluid communication with hollow center or main passageway 58 (see FIG. 4) of handle 46 such that fresh water from supply hose 6 is conducted to cup 28. A sleeve 60 joins handle 46 to stem 52 of connector 50 if these components are formed separately. Sleeve 60, which may be of a material which shrinks when exposed to heat, also anchors the end of connector hose 48.

Figure 4:
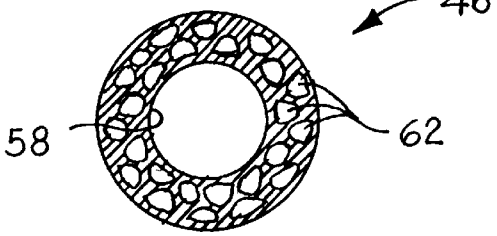
FIG. 4 is a cross sectional detail view of the invention, taken along line 4—4 of FIG. 1.

Handle 46 is light in weight, corrosion resistant, and rigid. FIG. 4 illustrates cross sectional configuration of handle 46. It will be seen that the outer, solid portion of handle 46 has honeycomb configuration. As employed herein, honeycomb configuration signifies that the outer portion of handle 46 has a plurality of relatively small axially extending interstitial passages 62 surrounding passageway 58. Passages 62 may be of any cross sectional configuration and serve to reduce weight and density of handle 46 while reinforcing handle 46 to improve rigidity thereof. Similarly, the solid portion of handle 46 may take any configuration as long as weight of handle 46 is minimized and rigidity of handle 46 is enhanced. At least the outer circumferential section of handle 46 is formed from fiberglass structural material. That portion of handle 46 defining interstitial spaces 62 could be formed from a synthetic resin if desired.

Connector 50 is so configured and dimensioned as to impart certain important characteristics to accessory 10. Returning to FIG. 2, one characteristic is that axis 64 of handle 46 is displaced or offset from centerline 66 of member 18 of spring 16. Magnitude of this offset is indicated as arrow 68. Handle 46 and its axis 64 are located above member 18 and its respective axis 66, as viewed in the depiction of FIG. 2. Opening 56 is upwardly directed with respect to handle 46 and slightly to the side thereof, as seen in FIG. 2.

A consequence of this aspect of the orientation between flushing attachment 14 and handle 46 is that connector hose 48 can remain fairly straight, generally occupying a plane as it extends from hole 56 (see FIG. 3) to fitting 44. Connector hose 48 is therefore unencumbered by severe bends and does not project significantly away from either handle 46 or from cup 28. This results in improved service life of connector hose 48, as severe bends would tend to cause kinking and cracking. The direct route taken by connector hose 48 renders accessory 10 compact, and hose 48 is less susceptible to snagging on external environmental objects and being pulled free from stem 52 of connector 50 and from fitting 44 than otherwise would be the case.

Figure 5:
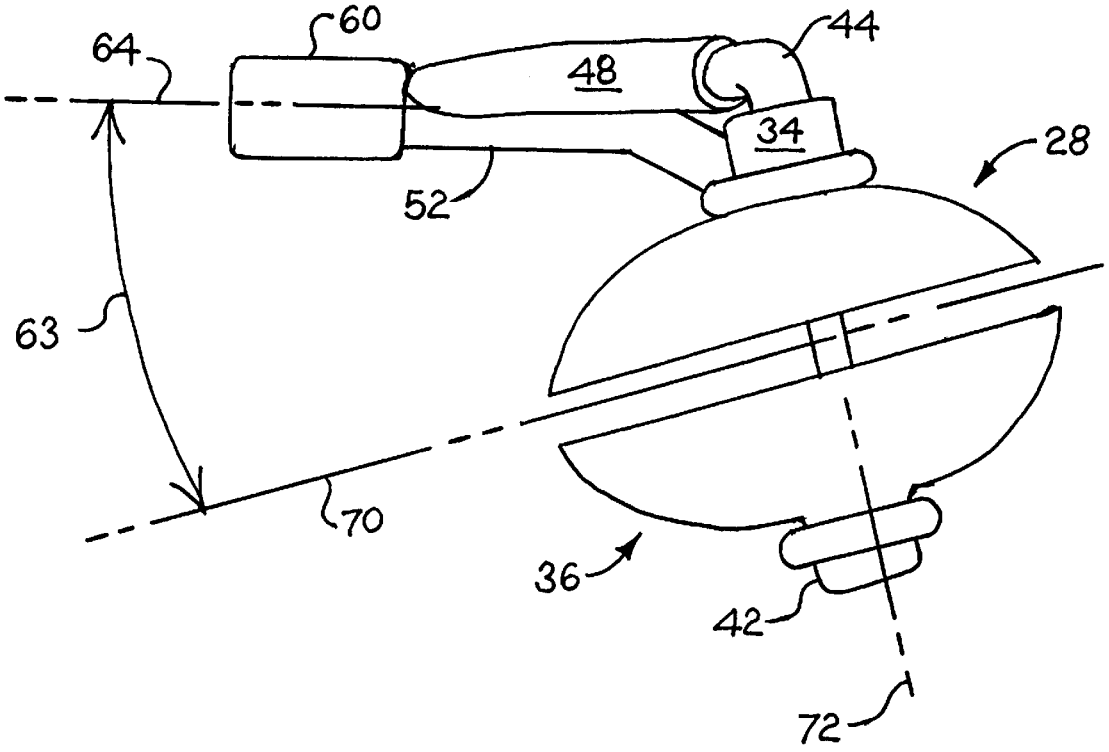
FIG. 5 is an exaggerated top plan detail view of the invention.

Another characteristic of configuration of accessory 10 is shown in FIG. 5. Alignment of a central plane 70 which is generally parallel to and disposed between cups 28 and 36 is disposed at an angle 63 to axis 64 of handle 46. Plane 70 may be regarded as being perpendicular to a centerline 72 passing through respective stubs 34, 42 of cups 28, 36. By contrast with angle 63, this relationship is typically parallel in prior art devices. An advantage conferred by the novel orientation is that the user can maneuver accessory 10 while not being obliged to stand or sit almost directly behind the outboard engine. Stated another way, the user can maneuver accessory 10 over the outboard engine without encountering interference with the outboard engine.

The user can also control water flow from his or her vantage point within the boat. As seen in FIG. 1, a manually operated in-line valve 74, such as a butterfly valve or ball valve is provided at terminal 12 of handle 46.

It is to be understood that the present invention is not limited to the embodiments described above, but encompasses any and all embodiments within the scope of the following claims.

I claim:

1. A flushing accessory which is readily and remotely installable over the lower unit of a marine outboard engine, comprising:

a flushing attachment comprising a U-shaped spring having a first straight member terminating in a proximal end, a second straight member terminating in a distal end, and a bent portion connecting said first straight member to said second straight member, a first flexible sealing cup having a bowl portion defining an interior portion and a stub projecting from said bowl portion, wherein said first cup is fixed to said proximal end of said spring by engagement of said stub by said spring, and a second flexible sealing cup having a bowl portion and a stub projecting from said bowl portion, wherein said second cup is fixed to said distal end of said spring by engagement of said stub by said spring, wherein said stub of said first cup has a throughbore communicating with said interior of said bowl portion of said first cup;

an elongate handle having a main passageway extending axially therealong;

a hose connecting said passageway to said throughbore of said first cup, whereby fluid can flow from said handle into said first cup through said hose;

a connector disposed to mount rigidly to said handle and to said flushing attachment and to hold said flushing attachment in fixed, permanent orientation relative to said handle, wherein said connector is fabricated from a corrosion resistant material; and an elbow fitting connecting said hose to said cup, wherein said connector has a hollow stem fixed to said handle, said hollow stem having an upwardly directed opening for receiving said hose, and said hose enters said hollow stem at said upwardly directed opening and establishes fluid communication between said elbow fitting and said handle;

wherein said handle has an axis, and said connector engages said flushing attachment by engaging one of said first straight member and said second straight member such that the engaged one of said first straight member and said second straight member is offset from alignment with said axis of said handle; and said handle has honeycombed construction wherein said handle has a plurality of relatively small axially oriented passages surrounding said main passageway of said handle.

2. A flushing accessory which is readily and remotely installable over the lower unit of a marine outboard engine, comprising:

a flushing attachment comprising a U-shaped spring having a first straight member terminating in a proximal end, a second straight member terminating in a distal end, and a bent portion connecting said first straight member to said second straight member, a first flexible sealing cup having a bowl portion defining an interior portion and a stub projecting from said bowl portion, wherein said first cup is fixed to said proximal end of said spring by engagement of said stub by said spring, and a second flexible sealing cup having a bowl portion and a stub projecting from said bowl portion, wherein said second cup is fixed to said distal end of said spring by engagement of said stub by said spring, wherein said stub of said first cup has a throughbore communicating with said interior of said bowl portion of said first cup;

an elongate handle having a main passageway extending axially therealong;

a hose connecting said passageway to said throughbore of said first cup, whereby fluid can flow from said handle into said first up through said hose; and a connector disposed to mount rigidly to said handle and to said flushing attachment and to hold said flushing attachment in fixed, permanent orientation relative to said handle, wherein said connector is fabricated from a corrosion resistant material;

wherein said flushing attachment has an elbow fitting connecting said hose to said cup, said connector has a hollow stem fixed to said handle, said hollow stem having an upwardly directed opening for receiving said hose, and said hose enters said hollow stem at said upwardly directed opening and establishes fluid communication between said elbow fitting and said handle.

3. The flushing accessory according to claim 2, wherein said handle has an axis, and said connector engages said flushing attachment by engaging one of said first straight member and said second straight member such that the engaged one of said first straight member and said second straight member is offset from alignment with said axis of said handle.

4. A flushing accessory which is readily and remotely installable over the lower unit of a marine outboard engine, comprising:

a flushing attachment comprising a U-shaped spring having a first straight member terminating in a proximal end, a second straight member terminating in a distal end, and a bent portion connecting said first straight member to said second straight member, a first flexible sealing cup having a bowl portion defining an interior portion and a stub projecting from said bowl portion, wherein said first cup is fixed to said proximal end of said spring by engagement of said stub by said spring, and a second flexible sealing cup having a bowl portion and a stub projecting from said bowl portion, wherein said second cup is fixed to said distal end of said spring by engagement of said stub by said spring, wherein said stub of said first cup has a throughbore communicating with said interior of said bowl portion of said first cup;

an elongate handle having a main passageway extending axially therealong;

a hose connecting said passageway to said throughbore of said first cup, whereby fluid can flow from said handle into said first up through said hose; and a connector disposed to mount rigidly to said handle and to said flushing attachment and to hold said flushing attachment in fixed, permanent orientation relative to said handle, wherein said connector is fabricated from a corrosion resistant material;

wherein said handle has honeycombed construction wherein said handle has a plurality of relatively small axially oriented passages surrounding said main passageway of said handle.

5. The flushing accessory according to claim 4, wherein said handle comprises fiberglass structural material.

6. The flushing accessory according to claim 2, wherein said connector is formed from a synthetic resin.

7. The flushing accessory according to claim 2, wherein said handle has a manually operated in-line valve disposed to control flow of water therethrough.

* * * * *